US005950437A

United States Patent [19]

Turner et al.

[11] Patent Number: 5,950,437

[45] Date of Patent: Sep. 14, 1999

[54] SYSTEM AND METHOD FOR CHARGING INSULATED CONTAINERS WITH CRYOGENIC LIQUIDS

[75] Inventors: Jon Robert Turner, Lakeville; Timothy Allan Neeser, Scott City, both of Minn.

[73] Assignee: MVE, Inc., New Prague, Minn.

[21] Appl. No.: 09/038,745

[22] Filed: Mar. 11, 1998

[51] Int. Cl.[6] ..... F17C 7/02

[52] U.S. Cl. ..... 62/50.1; 141/4; 222/3

[58] Field of Search ..... 62/50.1; 141/4; 222/3

[56] References Cited

U.S. PATENT DOCUMENTS

| | | | |
|---|---|---|---|
| 2,944,406 | 7/1960 | Anderson | 62/50.1 |
| 2,956,412 | 10/1960 | Loebeck | 62/50.1 |
| 3,633,372 | 1/1972 | Kimmel et al. | 62/50.1 |
| 3,797,263 | 3/1974 | Shahir et al. | 62/50.1 |
| 4,475,348 | 10/1984 | Remes . | |
| 4,683,921 | 8/1987 | Neeser . | |
| 5,174,357 | 12/1992 | Neeser . | |
| 5,234,035 | 8/1993 | Neeser . | |

*Primary Examiner*—Ronald Capossela
*Attorney, Agent, or Firm*—Rudnick & Wolfe

[57] ABSTRACT

An insulated container that is open on top and contains phase change material travels along a conveyor. The container initially stops under an infrared sensor whereat its initial interior temperature is determined. A microprocessor uses the temperature data to determine the amount of cryogenic liquid that must be added to the container so that its phase change material will be frozen to a predetermined temperature. A cryogenic liquid dispenser charges the container with an amount of cryogenic liquid determined by the microprocessor. The cryogenic liquid dispenser includes a phase separator which depressurizes cryogenic fluid received from a bulk storage tank. Once the container is charged, it may be loaded with perishables, examples of which include food, blood or chemicals.

19 Claims, 3 Drawing Sheets

SYSTEM AND METHOD FOR CHARGING INSULATED CONTAINERS WITH CRYOGENIC LIQUIDS

BACKGROUND

The demands of the modem workplace often leave an individual with little time at the end of the day for the preparation of a meal. Upon returning home, a working individual often does not want to spend time or effort in the kitchen preparing dinner.

Many potential solutions to these problems have been presented. For example, fast food and carry-out restaurants have proven to be quite popular. The individual can pick up his or her dinner on the way home from work. This solution suffers from the disadvantages, however, of a rather limited menu selection and the food is not palatable to many people. Furthermore, the food often gets cold by the time the person arrives home. Frozen meals or "TV dinners" have been around for a long time but, again, many people find that the taste of such prepackaged meals, often prepared weeks or months earlier, leaves a lot to be desired. In addition, maintaining an ample supply of the frozen meals requires excessive freezer space. A demand exists for an alternative approach to provide good quality meals that can be quickly prepared.

In response to this demand, a number of meal delivery services have been developed. These services offer restaurant-quality meals that are delivered frozen to the customer's home, regardless if the customer is home or not. As such, these services offer a high level of convenience for the customer. The services offer a menu with a wide selection of meal choices.

The frozen meals are left on a customer's doorstep in a container much in the same manner that milkmen of days past delivered milk. The containers include a source of refrigeration and are insulated so as to preserve the food in a frozen state. The customer, upon returning home, takes the frozen food out of the container, heats it in an oven and then enjoys a quickly prepared yet fresh tasting, delicious meal. The empty container is left on the customer's doorstep for replacement with a filled container by the delivery service the next day.

To maintain the delivered food in a frozen state, the containers used by the services must be insulated and include a source of internal refrigeration. The containers currently used feature foam insulation construction and contain gel packs filled with phase change material. In addition, high efficiency containers that are vacuum insulated and that use a minimal number of gel packs have recently been developed. Such a container is the subject of copending and commonly assigned U.S. patent application Ser. No. 08/886,669. Typically, the phase change material within the gel packs is packaged refrigerant gel that can be chilled to a temperature well below the freezing point of water. As such, frozen gel packs positioned within a container refrigerate food placed within the container.

Traditionally, the insulated containers used by delivery services have been prepared for use by placing the gel packs, and/or the containers themselves, in a walk-in freezer so as to freeze the phase change material and cool the containers to a desired temperature. A disadvantage of such an arrangement is that the gel packs take a long time to freeze. In addition, a large freezer space is required to prepare a sufficient number of containers. The required freezers for such an operation are expensive to purchase and use. Workers preparing the containers must also spend a significant amount of time within the freezers and thus suffer prolonged exposure to temperatures of around −18° F. This results in increased worker discomfort, fatigue and potential illness.

Accordingly, it is an object of the present invention to provide a system whereby the phase change material within an insulated container may be quickly frozen to a predetermined temperature.

Another object of the present invention is to provide a system whereby the phase change material within an insulated container may be frozen to a predetermined temperature without the use of a large freezer.

Another object of the present invention is to provide a system whereby the phase change material within an insulated container may be frozen to a predetermined temperature with minimal labor.

SUMMARY

The present invention is directed to a system for charging an insulated container with cryogenic liquid so that the phase change material therein is quickly frozen to a predetermined temperature. The container to be prepared is initially placed upon a conveyor with its top open. The container passes under an infrared sensor that determines the initial temperature within the container. The temperature data from the infrared sensor is relayed to a microprocessor based controller which employs a lookup table. This lookup table lists, for an initial container interior temperature, the quantity of a cryogenic liquid that must be added to the container in order to freeze the phase change material therein to the predetermined temperature. Accordingly, once the controller has received the temperature data from the infrared sensor, the quantity of cryogen to be added to the container is determined. Alternatively, the amount may be computed using standard formulas.

After the container leaves the infrared sensor, it travels along the conveyor until it is positioned under a cryogenic liquid dispenser. The cryogenic liquid dispenser features a valve that regulates the flow of cryogenic liquid therethrough. This valve is manipulated by a solenoid that is in communication with the controller. The controller causes the solenoid to open the valve for the period of time required to dispense the proper amount of cryogenic liquid into the container.

The cryogenic liquid dispenser receives its supply of cryogenic liquid from a phase separator which, in turn, is supplied with cryogenic fluid from a bulk storage tank. The phase separator depressurizes cryogenic fluid received from the bulk tank and vents off the gas produced thereby so that the liquid which remains may be used to charge the container.

Once the container has been charged with cryogenic liquid, perishables such as food, blood, or chemicals may be loaded into its interior and the container lid closed. The container may then be transported to the customer.

For a more complete understanding of the nature and scope of the invention, reference may now be had to the following detailed description of embodiments thereof taken in conjunction with the appended claims and accompanying drawings.

DESCRIPTION

Figure 1:
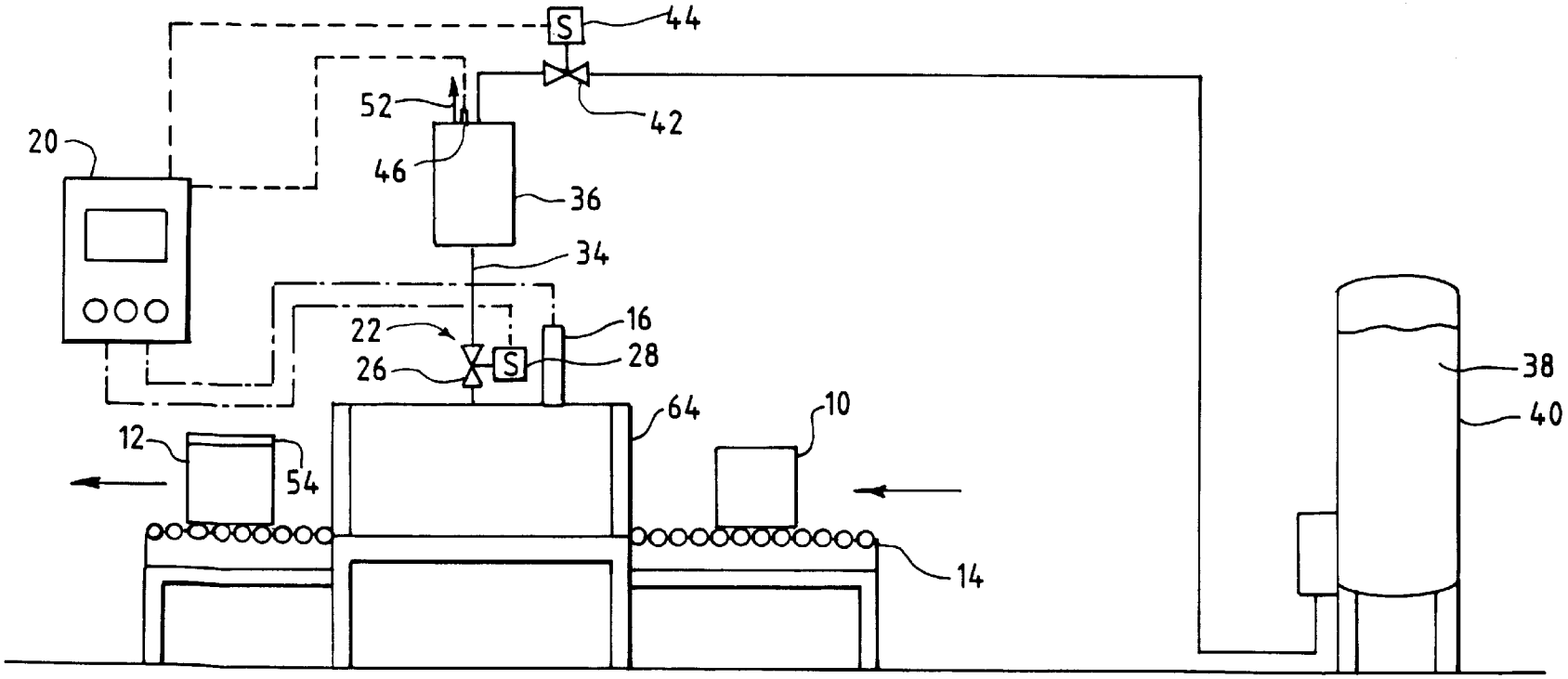
FIG. 1 is a schematic illustration of an embodiment of the system of the present invention.

Referring to FIG. 1, a schematic of an embodiment of the system of the present invention is shown. The system charges insulated containers with cryogenic liquids, that is, liquids having a boiling point lower than −150° F., so that phase change materials (such as gel packs) are frozen to a desired temperature. After a container is charged, it may be used to transport and store a variety of perishables, examples of which include food, blood, chemicals or a variety of other substances.

The system of the invention may be used to charge virtually any type of insulated container containing a phase change material. For optimum efficiency, however, it is preferable to utilize the system to charge a vacuum insulated container that features phase change material positioned so that it may be easily accessed by liquid poured into the container. Such a container is the subject of copending and commonly assigned U.S. patent application Ser. No. 08/886,669, filed Jul. 1, 1997, the contents of which are incorporated herein by reference.

In FIG. 1, container 10 is just entering the system and thus has not yet been charged with cryogenic liquid. In contrast, container 12 has just completed the process and thus has been charged with cryogenic liquid so that its gel packs, or other type of phase change materials, are frozen to a desired temperature. As shown in FIG. 1, container 10 is initially placed upon conveyor 14 facing upwards with its top open. Conveyor 14 transports containers through the system and may either be automated or operated by a worker pushing the container.

Container 10 progresses along conveyor 14 until it is positioned under an infrared temperature sensor 16 (hereinafter the "IR sensor"). Such IR sensors are available from, for example, Exergen, Inc. of Watertown, Mass. Once the container is in position, IR sensor 16 is activated so that the initial interior temperature of the container is determined. The temperature data is transmitted to a controller 20.

Controller 20 preferably includes a microprocessor and associated memory into which a lookup table is programmed. The lookup table lists, for an initial container interior temperature, the quantity of cryogenic liquid that should be supplied to the container in order to freeze the phase change material therein to a predetermined temperature. An example of such a lookup table, wherein liquid nitrogen is the cryogenic liquid, is as follows:

Liquid Nitrogen Requirements to Cool a Container with 3 lbs. of Phase Change Material to −50° F. with Ambient Temperature = 70° F.

| Infrared Sensor Reading of Initial Container Interior Temperature (° F.) (=$T_{meas.}$) | Quantity of Liquid Nitrogen Required (Liters) (=$LN_2$) |
|---|---|
| 70 | 4.3 |
| 60 | 4.1 |
| 50 | 3.9 |
| 40 | 3.7 |
| 30 | 3.5 |
| 20 | 3.4 |
| 10 | 3.2 |
| 0 | 3.0 |
| −10 | 2.8 |
| −15 | 0.6* |

*phase change material still frozen

Accordingly, when controller 20 receives temperature data from IR sensor 16, it may determine the quantity of cryogenic liquid that should be added to the container by the system.

Using the above table in an example, if a container initially had a interior temperature of 20° F. and contained 3 lbs. of phase change material, 3.4 liters of liquid nitrogen would need to be added to the container to freeze the phase change material to a temperature of −50° F. It is to be noted that the use of liquid nitrogen as the cryogenic liquid and the values of the above table are presented as examples only and are not intended to limit the scope of the invention in any way.

As an alternative to using a lookup table, the microprocessor of control panel 20 may calculate the required amount of cryogenic liquid for a given initial container interior temperature by using an equation such as the following:

$$LN_2(\text{Liters}) = \frac{[10.5\ \text{lbs.} \times .25\ \text{BTU/lb.}\ ^\circ\text{F.} \times (T_{meas.} - (-50^\circ\text{F.}))] + [3\ \text{lbs.} \times 111\ \text{BTU/lb.}]}{85.6\ \text{BTU/lb.} \times 1.782\ \text{lbs./ltr.}}$$

This equation is presented as an example only and is in no way intended to limit the scope of the invention.

The determination of the initial container temperature is necessary because containers charged by the system may possess a wide variety of initial interior temperatures. For example, in situations in which the container is used to provide a meal delivery service, a customer may be home at the time the frozen meal is delivered. Under such circumstances, the customer would normally take the meal and immediately give the container back to the delivery person. As a result, the container would be returned to the preparation facility at a temperature only slightly warmer than the temperature at which the container was sent out.

If such a container were prepared using the same quantity of cryogenic liquid as a container with a considerably warmer interior, a good deal of the cryogenic liquid added would be unnecessary and thus wasted. Furthermore, adding the extra unnecessary cryogenic liquid would take additional time thus resulting in a decreased utilization of resources. Finally, adding the extra cryogenic liquid to the container could be dangerous to workers or customers as the temperature within the container could drop below safe access levels. As a result, by determining the initial container interior temperature, the system is able to provide material and time savings as well as increased safety for both workers and customers.

For optimal efficiency, the predicted ambient temperature range for the day could be taken into consideration when charging the containers. For example, if a very cold day was forecast, only a portion of the phase change material would need to be frozen since heat leak into the container would be less than on a warmer day. While this practice would lower the overall consumption of the liquid cryogen, a margin of safety in charging the containers would have to be maintained in the event that the ambient temperature rose above the predicted levels.

Figure 2:
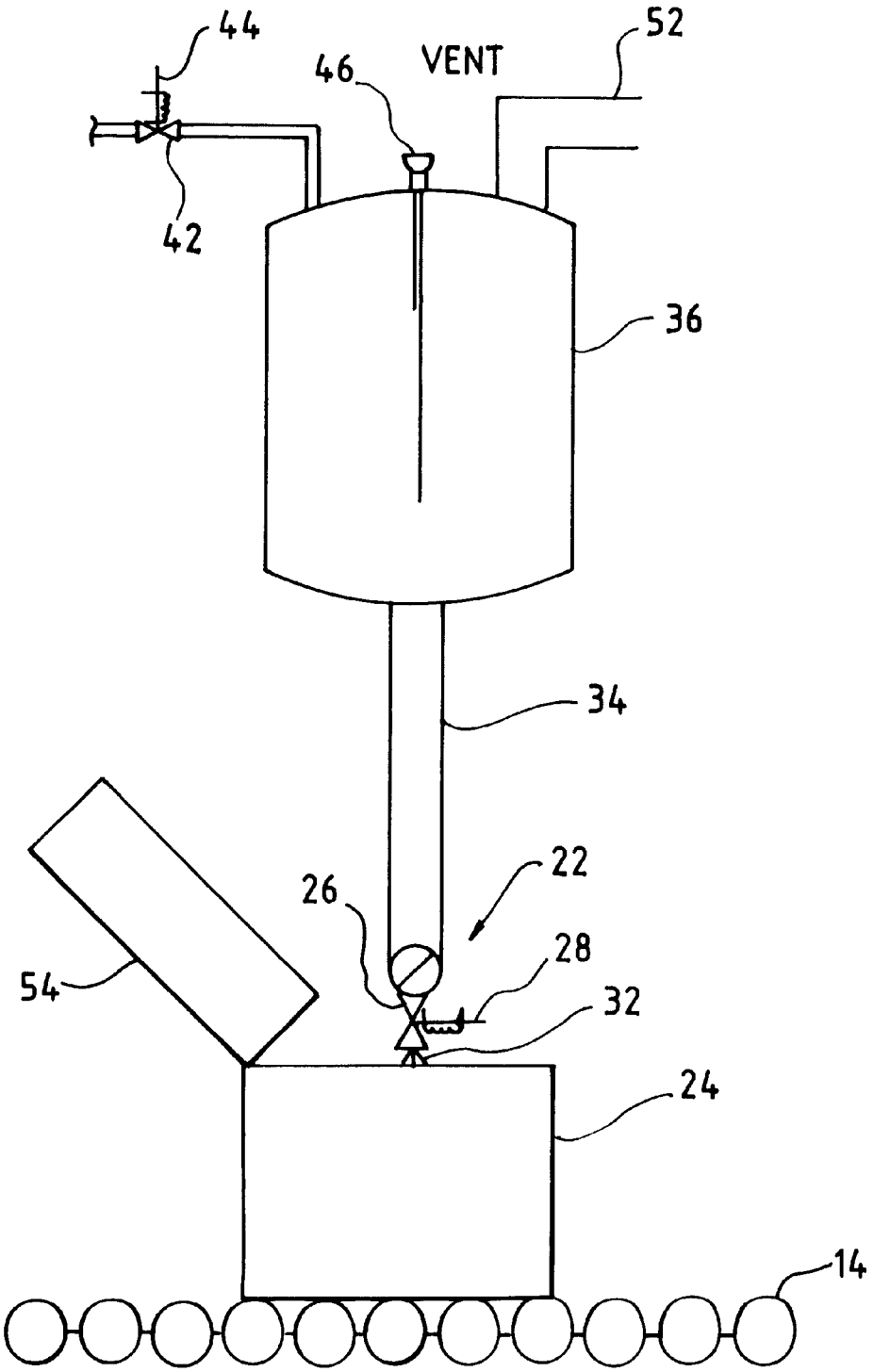
FIG. 2 is a schematic illustration showing the detail of the phase separator and the cryogenic liquid dispenser of the system of FIG. 1.

After IR sensor 16 has taken its reading, the container travels along conveyor 14 until it is positioned under a cryogenic liquid dispenser, indicated generally at 22. A container in such a position is indicated at 24 in FIG. 2. As shown in FIG. 2, cryogenic liquid dispenser 22 features a valve 26 that is activated by a solenoid 28. As shown in FIG. 1, solenoid 28 is in communication with controller 20. Controller 20, having determined a required amount of cryogenic liquid as described above, controls solenoid 28 which in turn manipulates valve 26 so that the proper amount of cryogen is delivered into container 24. More specifically, controller 20 sends a signal to solenoid 28 to open valve 26 for a period of time, permitting the flow of cryogenic liquid 32 into container 24. This period of time corresponds to the amount of time that valve 26 must be open in order to deliver the proper amount of cryogenic liquid into container 24. After controller 20 determines that this period of time has expired, it sends a signal to solenoid 28 which in turn closes valve 26 so that the flow of cryogenic liquid into container 24 stops.

Cryogenic liquid dispenser 22 is supplied cryogenic liquid through piping 34 from a storage vessel that preferably takes the form of phase separator 36. As shown in FIG. 1, phase separator 36 receives its supply of cryogenic liquid from a bulk supply 38 of cryogenic fluid stored within bulk tank 40. As shown in FIGS. 1 and 2, the supply of cryogenic fluid from bulk tank 40 to phase separator 36 is regulated by valve 42. Valve 42 is manipulated by solenoid 44 which, as shown in FIG. 1, is in communication with controller 20.

Disposed within phase separator 36 is liquid level sensor 46. As shown in FIG. 1, liquid level sensor 46 is also in communication with controller 20. Liquid level sensor 46 monitors the cryogenic liquid level within phase separator 36 and sends a signal to controller 20 when phase separator 36 is less than half full. When this occurs, controller 20 sends a signal to solenoid 44 whereby valve 42 is opened thereby causing cryogenic fluid from bulk tank 40 to flow to phase separator 36 until it is full. At this time, controller 20 closes valve 42 stopping the flow of cryogenic fluid into phase separator 36.

As shown in FIGS. 1 and 2, phase separator 36 also features a vent 52. Cryogenic fluid supplied to phase separator 36 from bulk tank 40 contains both cryogenic liquid and cryogenic vapor. Referring to FIG. 2, container 24 is most efficiently charged when flow 32 consists solely of cryogenic liquid. Accordingly, in order to remove the cryogenic vapor from the liquid contained therein, phase separator 36 is vented to the atmosphere via vent 52 so that its pressure is reduced to atmospheric pressure. As a result, the vapor separates from the cryogenic liquid and escapes through vent 52. This arrangement also maintains the pressure above valve 26 at a more constant level since the pressure in phase separator 36 is not ultimately dictated by the pressure in bulk tank 40.

Once the container has been charged with the proper quantity of cryogenic liquid, it travels to the position indicated at 12 in FIG. 1. At this time, container 12 may be packed with the perishable items and its lid 54 (FIGS. 1 and 2) closed so as to minimize the warming of its interior. Container 12 may then be placed in a freezer for storage or alternatively may be immediately loaded upon a delivery truck for transport to the customer.

Figure 3:
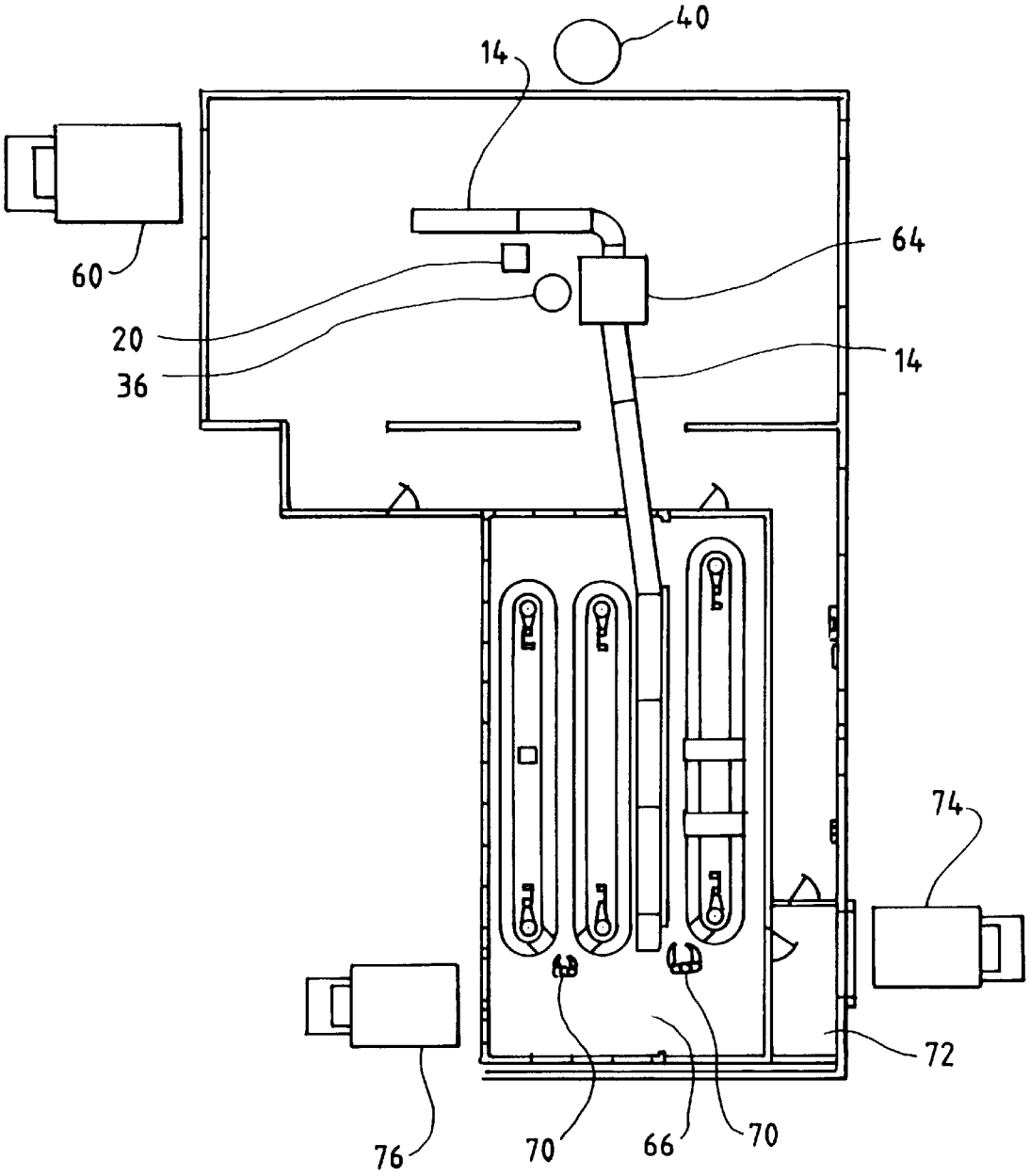
FIG. 3 is a plan view of a typical frozen meal service preparation facility utilizing the system of FIG. 1.

Referring to FIG. 3, a plan view of a facility is shown that uses the system of the invention to prepare containers for a frozen meal delivery service. Delivery trucks returning from the customers' homes 60 contain a supply of empty insulated containers. These containers are unloaded from delivery truck 60 and placed upon conveyor 14. The containers proceed along conveyor 14 to precooling unit 64. Precooling unit 64 contains IR sensor 16 and cryogenic liquid dispenser 22 so that a container passing therethrough is charged with cryogenic liquid as described above.

After exiting precooling unit 64, a container continues to travel along conveyor 14 until it reaches loading and corking area 66. It is in this area that the meals are prepared and loaded by workers 70 into the charged containers. Next, the container lids are closed and they may be placed in a freezer 72 for storage and later delivery by delivery truck 74. Alternatively, the containers may be immediately loaded on delivery truck 76 for transport to the customer. For longer distances or warmer climates, the amount of phase change material in the containers could be increased. Also, the delivery trucks may optionally be refrigerated.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for charging an interior of an insulated container with a quantity of cryogenic liquid comprising:

a) means for determining an initial temperature within said container;

b) means for determining a required amount of cryogenic liquid to be dispensed into the container, based upon said initial temperature, to cool the container interior to a predetermined temperature; and c) a dispenser for dispensing said required amount of cryogenic liquid into the container.

2. The system of claim 1 wherein the means for determining an initial temperature is an infrared sensor.

3. The system of claim 1 wherein said dispenser includes:

a) a supply of liquid cryogen; and b) a valve in communication with the supply of liquid cryogen, said determining means operating said valve for a period of time corresponding to said required amount of cryogenic liquid.

4. The system of claim 3 wherein said dispenser includes a phase separator for venting gas commingled with said cryogenic liquid before the liquid is dispensed.

5. The system of claim 1 wherein the cryogenic liquid is liquid nitrogen.

6. The system of claim 1 further comprising a conveyor for transporting the container sequentially to the means for determining an initial temperature and then to said dispenser.

7. The system of claim 1 further comprising a bulk tank for supplying cryogenic fluid to said dispenser.

8. A system for charging an interior of an insulated container with a quantity of cryogenic liquid comprising:

a) a temperature sensor for determining an initial temperature within the container;

b) a controller for determining a required amount of cryogenic liquid to be dispensed into the container, based upon the initial temperature, to cool the container interior to a predetermined temperature; and c) a dispenser for dispensing the required amount of cryogenic liquid into the container.

9. The system of claim 8 wherein the temperature sensor is an infrared sensor.

10. The system of claim 8 wherein the dispenser includes:

a) a supply of liquid cryogen; and b) a valve in communication with the supply of liquid cryogen, said controller operating said valve for a period of time corresponding to said required amount of cryogenic liquid.

11. The system of claim 10 wherein said dispenser includes a phase separator for venting gas commingled with said cryogenic liquid before the liquid is dispensed.

12. The system of claim 8 wherein the cryogenic liquid is liquid nitrogen.

13. The system of claim 8 further comprising a conveyor for transporting the container sequentially to the temperature sensor and then to the dispenser.

14. The system of claim 8 further comprising a freezer for storing the container after it has been charged with the required amount of cryogenic liquid.

15. The system of claim 8 further comprising a bulk tank for supplying cryogenic fluid to said dispenser.

16. A method for charging an insulated container with a cryogenic liquid comprising the steps of:

a) sensing an initial temperature within the container;

b) determining a required amount of cryogenic liquid to cool the container to a predetermined temperature based upon the initial temperature; and c) dispensing the required amount of cryogenic liquid into the container.

17. The method of claim 16 wherein an infrared sensor is used to sense the initial temperature within the container.

18. The method of claim 16 wherein a lookup table is used to determine the required amount of cryogenic liquid.

19. The method of claim 16 wherein a calculation is performed to determine the required amount of cryogenic liquid.

* * * * *